US005373896A

United States Patent [19]

Osborn

[11] Patent Number: 5,373,896

[45] Date of Patent: Dec. 20, 1994

[54] HEAT EXCHANGER ASSEMBLY

[75] Inventor: Robert J. Osborn, Orange, Conn.

[73] Assignee: The Allen Group, New Haven, Conn.

[21] Appl. No.: 122,056

[22] Filed: Sep. 15, 1993

Related U.S. Application Data

[62] Division of Ser. No. 859,108, Mar. 27, 1992, Pat. No. 5,257,662.

[51] Int. Cl.[5] ..... F28F 9/02

[52] U.S. Cl. ..... 165/173; 165/153; 29/890.043; 29/890.052

[58] Field of Search ..... 29/890.03, 890.052, 29/527.6, 557, 890,043; 165/76, 149, 173, 153, 175

[56] References Cited

U.S. PATENT DOCUMENTS

| | | | |
|---|---|---|---|
| 2,505,790 | 5/1950 | Panthoffer | 257/154 |
| 2,506,051 | 5/1950 | Young | 257/125 |
| 2,656,155 | 10/1953 | Garratt | 257/129 |
| 2,887,097 | 5/1959 | Huffman, Sr. et al. | 165/149 |
| 3,479,073 | 11/1969 | Collins | 287/189.36 |
| 3,512,805 | 5/1970 | Glatz | 285/109 |
| 3,939,908 | 2/1976 | Chartet | 165/149 |
| 4,026,456 | 5/1977 | Lema | 29/890.043 |
| 4,305,459 | 12/1981 | Nonnenmann et al. | 165/173 |
| 4,324,028 | 4/1982 | Severson | 29/157.3 |
| 4,324,290 | 4/1982 | Moranne | 165/173 |
| 4,331,201 | 5/1982 | Hesse | 165/153 |
| 4,378,174 | 3/1983 | Hesse | 403/274 |
| 4,382,464 | 5/1983 | Melnyk | 165/76 |
| 4,461,348 | 7/1984 | Toge et al. | 165/173 |
| 4,531,578 | 7/1985 | Stay et al. | 165/175 |
| 4,544,029 | 10/1985 | Cadars | 165/149 |
| 4,600,051 | 7/1986 | Wehrman | 165/149 |
| 4,651,815 | 3/1987 | Logic et al. | 165/76 |
| 4,678,026 | 7/1987 | Lenz et al. | 165/67 |
| 4,738,308 | 4/1988 | Moranne | 165/149 |
| 4,881,594 | 11/1989 | Beamer et al. | 165/173 |
| 4,917,182 | 4/1990 | Beamer | 165/173 |
| 5,160,474 | 11/1992 | Huff | 264/255 |
| 5,205,354 | 4/1993 | Lesage | 165/173 |

FOREIGN PATENT DOCUMENTS

| | | | |
|---|---|---|---|
| 256913 | 2/1988 | European Pat. Off. . | |
| 3312691 | 4/1983 | Germany . | |
| 58-148393 | 9/1983 | Japan . | |
| 420238 | 11/1934 | United Kingdom | 29/890.052 |
| 2108648 | 5/1983 | United Kingdom . | |

*Primary Examiner*—John Rivell
*Assistant Examiner*—L. R. Leo
*Attorney, Agent, or Firm*—DeLio & Peterson

[57] ABSTRACT

A heat exchanger includes a metal tank having an open side and a flange around the open side, and a metal header plate connected to a plurality of heat exchanging tubes, the header plate having a channel around its periphery for mating with the tank flange. The cast metal tank has predominately thin walls and at least one cast indentation point for starting a drilled hole. The indentation point is located in a defined, limited region of the tank walls having a thickness greater than surrounding wall regions. The indentation point may be drilled out and, optionally, tapped, to form an additional access opening in the tank.

22 Claims, 4 Drawing Sheets

Fig. 6
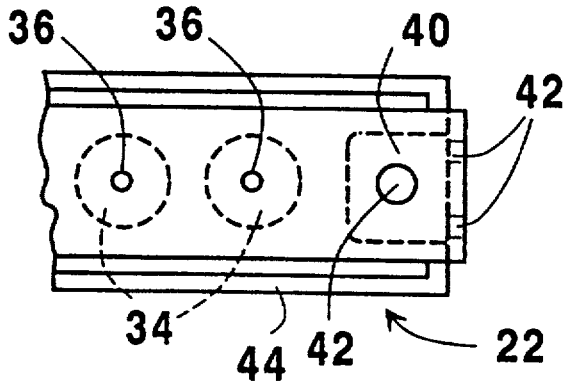
Fig. 7
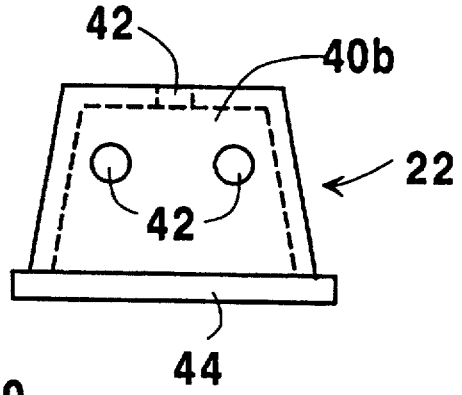
Fig. 8
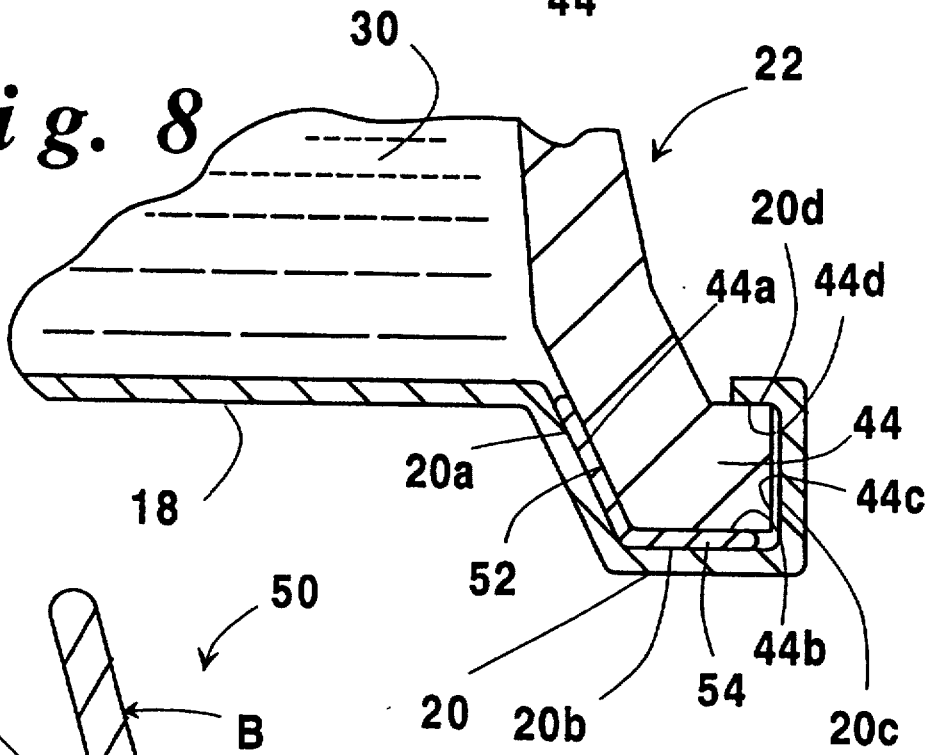
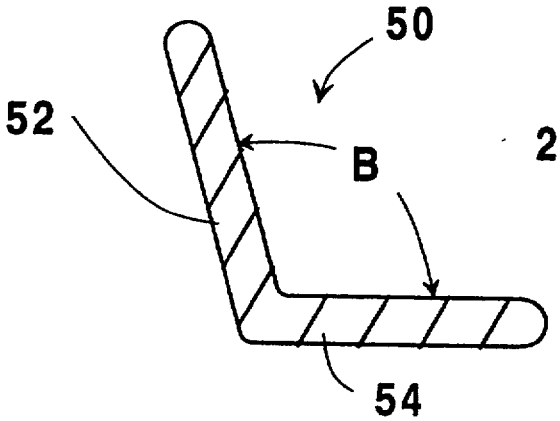
Fig. 9

HEAT EXCHANGER ASSEMBLY

This is a divisional of co-pending application Ser. No. 859,108 filed on Mar. 27, 1992 now U.S. Pat. No. 5,257,662.

BACKGROUND OF THE INVENTION

The present invention relates to a heat exchanger assembly, for example, a radiator employed in automotive applications, and a method of manufacturing such assembly.

In recent years, heat exchangers such as engine cooling radiators for high production automobiles and light and heavy trucks have been made with thermoplastic inlet and outlet tanks. Examples of such types of heat exchangers are found in the following U.S. Pat. Nos. 4,461,348, 4,531,578, 4,600,051, 4,651,815, 4,531,578 and 4,544,029, as well as U.K. Patent Application No. 2,108,648. The tanks generally have an open side with a flanged edge, and are assembled to the heat exchanger headers by crimping a channel around the header plate over the flanged tank edges. The joint is sealed by means of an elastomeric gasket arranged between a tank and a header. This type of configuration generally provide a less expensive assembly than soldering, bolting or otherwise bonding or mechanical ly securing the tanks to the headers. The use of plastic tank material is less expensive than the usual drawn brass, steel or stainless steel tank. Additionally, the assembly operation is faster and requires less skill.

While these types of conventional heat exchanger configurations utilizing plastic tanks are useful in many applications, they have drawbacks when contemplated for use in low volume motor vehicle and other applications because of the fact that expensive and inflexible tooling is required for molding the plastic tanks. Examples of such low volume applications are street sweepers, airport service vehicles and the like, and some heavy duty truck applications. Other low volume applications include stationary applications such as engine driven generator sets. Plastic tanks cannot be reconfigured easily, for example, to move the location of inlet or outlet ports or to add brackets or fittings- In addition, without elaborate reinforcement, the plastic material of the tank is generally not strong enough to allow the heat exchanger to be mounted by means of the tanks. Furthermore, in some heavy duty applications, the plastic tank material has been found to lack strength in the area where the inlet and outlet ports join the tanks, resulting in field failure due to shock and vibration. Metal tanks would provide better strength in this regard if they could be configured for maximum flexibility in manufacturing.

Bearing in mind the problems and deficiencies of the prior art, it is therefore an object of the present invention to provide a heat exchanger assembly which provides increased strength and durability in heavy or severe duty applications.

It is another object of the present invention to provide a heat exchanger assembly which, for low volume applications, perm its inexpensive changes in configuration of access openings, such as inlet and outlet ports, without expensive tooling changes.

It is a further object of the present invention to provide a heat exchanger configuration which permits the use of metal castings for the tank components.

It is yet another object of the present invention to provide a heat exchanger assembly which utilizes a cast metal tank but which is not susceptible to internal corrosion problems caused by coolant stagnation in crevices therein.

It is a further object of the present invention to provide a method of making the heat exchanger which meets the aforestated objects.

SUMMARY OF THE INVENTION

The above and other objects, which will be apparent to those skil led in the art, are achieved in the present invention which is directed in a first aspect to a heat exchanger comprising a metal tank having an open side and a flange around the open side, the flange having a side surface facing inward and a lower surface facing away from the tank. A metal header plate connected to a plurality of heat exchanging tubes includes a channel around its periphery for mating with the tank flange, the channel having a bottom wall facing and spaced from the flange lower surface and a side wall facing and spaced from the flange side surface. An elastomeric gasket between the flange and the channel forms a liquid-tight seal therebetween by completely filling the space between the flange side and lower surfaces and the channel side and bottom walls, respectively, for restricting contact of coolant with tank and header plate surfaces therebetween and reducing crevice corrosion therein. Preferably, the gasket is preformed with a pair of legs extending in an approximate L-shape in cross sectional view prior to insertion between the flange and the channel . One leg of the L-shaped gasket is disposed between the flange side surface and the channel side wall and the other leg of the L-shaped gasket is disposed between the flange lower surface and the channel bottom wall.

In another aspect, the invention is directed to a method for making a heat exchanger comprising the steps of providing the aforementioned metal tank and metal header plate, inserting the aforementioned elastomeric gasket into the header plate channel such that the gasket completely covers the channel bottom and side walls, and mating the tank flange into the header plate channel.

In a further aspect, the present invention is directed to a heat exchanger tank comprising a cast metal tank having predominately thin walls and at least one cast indentation point for starting a drilled hole. The indentation point is located in a defined, limited region of the tank walls and has a thickness greater than surrounding wall regions.

In a related aspect, the present invention provides another method for making a heat exchanger which comprises first casting a metal tank having predominately thin walls and at least one indentation point for starting a drilled hole, the indentation point being cast in a defined region of the tank wall and having a thickness greater than surrounding wall regions. A hole is then drilled at the indentation point and, optionally, threads are tapped in the hole, for forming an access opening in the tank, the access opening being reinforced by the defined region of the tank wall having a thickness greater than surrounding wall regions. The tank so made is then attached to a heat exchanger header plate.

In yet another aspect, the present invention is directed to a method for making a heat exchanger comprising casting a metal tank having predominately thin walls and at least one access opening, e.g., a coolant inlet or outlet, in a defined region of the tank wall having a thickness greater than surrounding wall regions, and subsequently relocating the access opening and defined region of greater tank wall thickness from the original location as-cast in the tank to a different location on the tank. The tank may be attached to a heat exchanger header plate either before or after the step of relocating the access opening. Preferably, the relocation of the access opening is by cutting the access opening and defined region of greater tank wall thickness from its original location as-cast in the tank, cutting an opening in the tank at a different location, welding the access opening to the opening at the different location, and sealing any remaining opening at the original location of the access opening.

In a further aspect, the invention provides a heat exchanger comprising a cast metal tank having an open side and a flange around the open side, the metal tank further including an as-cast extension, preferably an integral metal plate, on an end of the tank having a hole or indentation therein for mounting the tank to a frame. A heat exchanger core is provided which comprises a metal header plate connected to a plurality of heat exchanging tubes, the header plate having a channel around its periphery for mating with the tank flange. An elastomeric gasket is disposed between the flange and the channel for forming a liquid-tight seal therebetween, the gasket restricting contact of coolant with surfaces between the tank and header plate and reducing crevice corrosion therein. A frame member extends along the heat exchanger core and is secured to the tank mounting extension for mounting the heat exchanger to another device.

BRIEF DESCRIPTION OF THE DRAWINGS

FIG. 6 is a top plan view of the tank shown in FIG. 3.

FIG. 7 is an end elevational view of the tank shown in FIG. 3.

FIG. 8 is a cross sectional view of the tank flange mated with the header plate channel of the heat exchanger shown in FIG. 1.

FIG. 9 is a cross sectional view of the preformed gasket shown in FIG. 8.

DETAILED DESCRIPTION OF THE INVENTION

Figure 1:
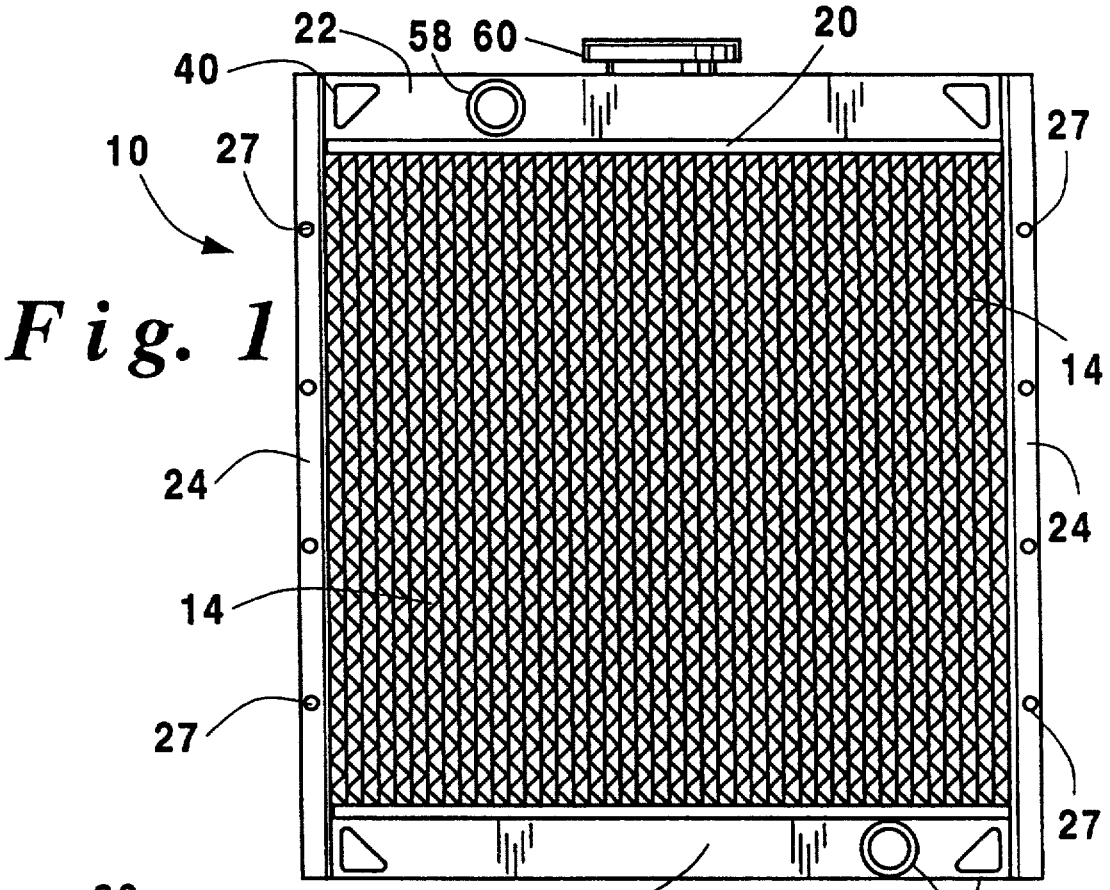
FIG. 1 is a front elevational view of the heat exchanger assembly in accordance with the present invention.

In describing the preferred embodiment of the present invention, reference will be made herein to FIGS. 1-11 of the drawings in which like numerals refer to like features of the invention. Features of the invention are not necessarily shown to scale in the drawings.

Figure 2:
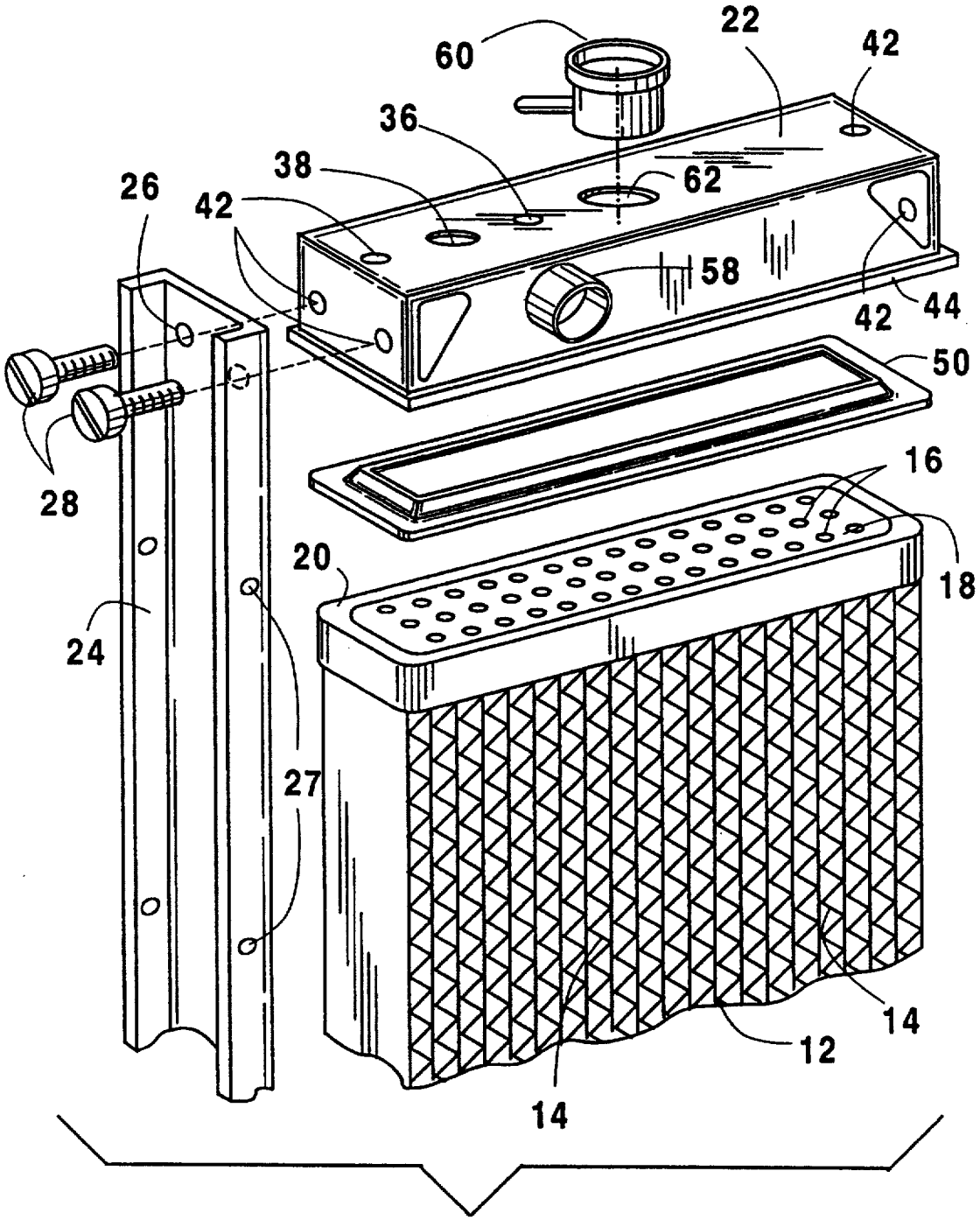
FIG. 2 is a perspective view, partially exploded, of a portion of the heat exchanger assembly shown in FIG. 1.

As shown in FIGS. 1 and 2, the heat exchanger assembly 10 incorporates a conventional core of an array of heat exchanging tubes 16 in thermal contact with fins 14. On each end of the core 12, the tubes 16 are fitted into corresponding openings in a header plate 18. The joints between the tubes 16 ends and header plate 18 openings are liquid-tight and may be made by any of the conventional processes well known in the art. The header plate is made of any metal normally employed in such applications, for example, brass, and includes around its periphery a channel 20 for mating with the heat exchanger tanks 22. Interposed between each header plate 18 and tank 22 is an elastomeric gasket 50 for forming a liquid-tight seal. This elastomeric gasket has a particular preferred configuration which will be discussed in more detail below. When used to seal the metal header plate with a tank made of a dissimilar metal, for example, aluminum, the preferred elastomeric gasket restricts contact of the coolant with any crevices between the tank and header plate services and reduces the possibility of corrosion occurring therebetween.

The tanks 22 preferred in the present invention are made by thin wall casting techniques, for example, vacuum sand casting which utilizes pattern tooling made of wood or some other material which makes it practical for low volume production applications. As shown, each tank 22 may include various access ports or openings such as openings 38, 58, 62 and 67, which may serve as various inlets or outlets for coolant to the assembled radiator 10. Some of these access openings have flange portions cast integrally with the tank, such as openings 58 and 67 on the upper and lower tank sections respectively. Other openings such as access opening 62 are merely holes in the tank wall which receive separate neck sections such as section 60 which serves as an inlet for filling and replenishing coolant in the radiator. The cast tank section 22 may also include as-cast indentations such as indentation 36, which provide location points for drilling openings, and which will be discussed in more detail below.

In order to provide for securing the header assembly components together in heavy duty applications, such as heavy duty truck applications, each tank 22 preferably includes an as-cast extension 40 which contains mounting holes or as-cast indentations for drilling mounting holes, identified as 42. Such extensions 40 provide integral plate members having openings therein which pass through the entire thickness of the plate, without passing through the wall of the liquid chamber portion of the tank itself, thereby providing a strong mounting location without the risk of developing a leak for the coolant. To complete the preferred structure of the radiator 10, a pair of straight U-shaped channel members 24 having flanges directed outwardly extend vertically along either side of the entire length of the core. Fasteners 28 bolt through openings 26 at the channel ends to the corresponding openings 42 in the tank extension plates 40. Additional holes 27 are provided on channel members 24 to either mount the heat exchanger assembly 10 to another apparatus or device in its intended application, or to mount accessory members on the assembly.

Tank 22 is preferably elongated and has an opening which is shaped to conform to the generally rectangular configuration of header plate 18. Each tank 22 has a open side around which periphery extends a flange 44 for mating with channel 20 which extends around the periphery of header plate 18. Where dissimilar metals are employed for the tank and header plate, such as in the preferred embodiment wherein the header plate is made of brass and the tank is made of aluminum, gasket 50 spaces and separates the tank 22 and header plate 18 at all regions of common contact with any coolant used in the heat exchanger. The tank is preferably secured to the core by crimping the outside edge of header plate channel 20 over the flange in any conventional manner, such as any of the configurations disclosed in the aforementioned U.S. Patents, the disclosures of which are hereby incorporated by reference.

Figure 3:
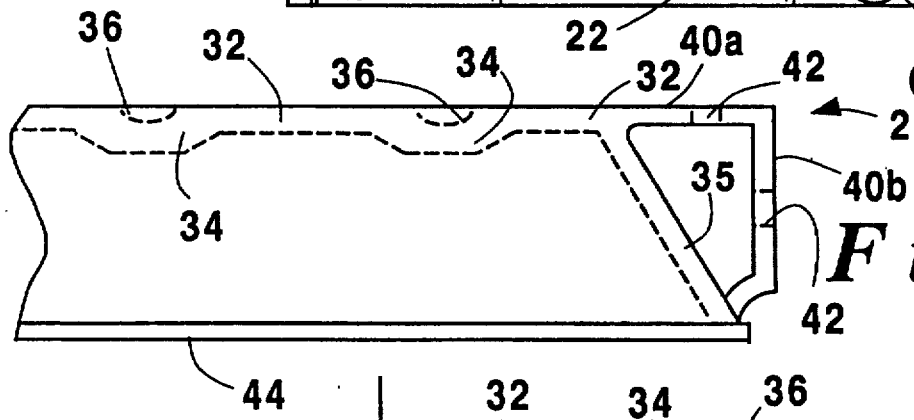
FIG. 3 is a front elevational view of a portion of the cast metal tank for the heat exchanger depicted in FIG. 1.
Figure 4:
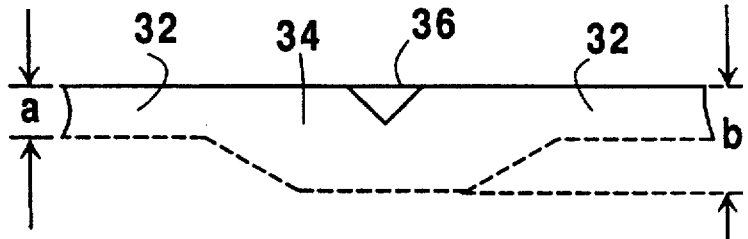
FIG. 4 is a cross sectional view of a portion of the wall of the tank of FIG. 3.

As seen in more detail in FIGS. 3, 6 and 7, the tank header mounting extension 40 preferably comprises a one piece, as-cast integral plate extending from the end of tank 22 in a horizontal section **40*a* which meets with a vertical section 40*b* extending upward from the base or flange region of the tank. The end wall 35 of the tank liquid chamber portion is angled at the end of the tank section in such a manner to provide space in back of extensions section 40*a* and 40*b* in order to secure mounting bolts or the like. In place of the openings 42 which are shown as extending completely through the plates portions 40*a* and 40*b***, indentations such as tapped blind holes may be utilized. The configuration of the mounting member extensions provides the reinforcing strength for mounting the tank members to a frame for the heat exchanger and/or directly to the device or apparatus in which it is used.

Figure 5:
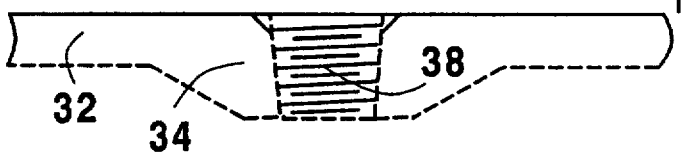
FIG. 5 shows the tank wall portion depicted in FIG. 4 after an access hole has been drilled and tapped.

When made by the preferred casting techniques, tank 22 may include as-cast indentations 36 (FIG. 3), which do not extend completely through the tank wall, to provide starting and/or centering points for drilling or cutting openings in the tank walls. As seen in more detail in FIG. 4, tank 22 has wall section 32 over a substantial portion over the tank exterior which has a relatively uniform thickness "a". Around each indentation point 36 there is provided a defined, limited region 34 in which the tank wall has a built-up thickness "b", preferably of at least 1.5 or 2 times the wall thickness "a". These defined regions 34 may be of any shape such as circular or the like (FIG. 6) to provide reinforcement around any openings made therein. As shown in FIG. 5, indentation 36 has been drilled out and tapped by conventional processes to provide an internally threaded access opening 38 to the tank. Such access openings need not be threaded, however, and can be made to accommodate other than threaded neck or flange members.

Figure 10:
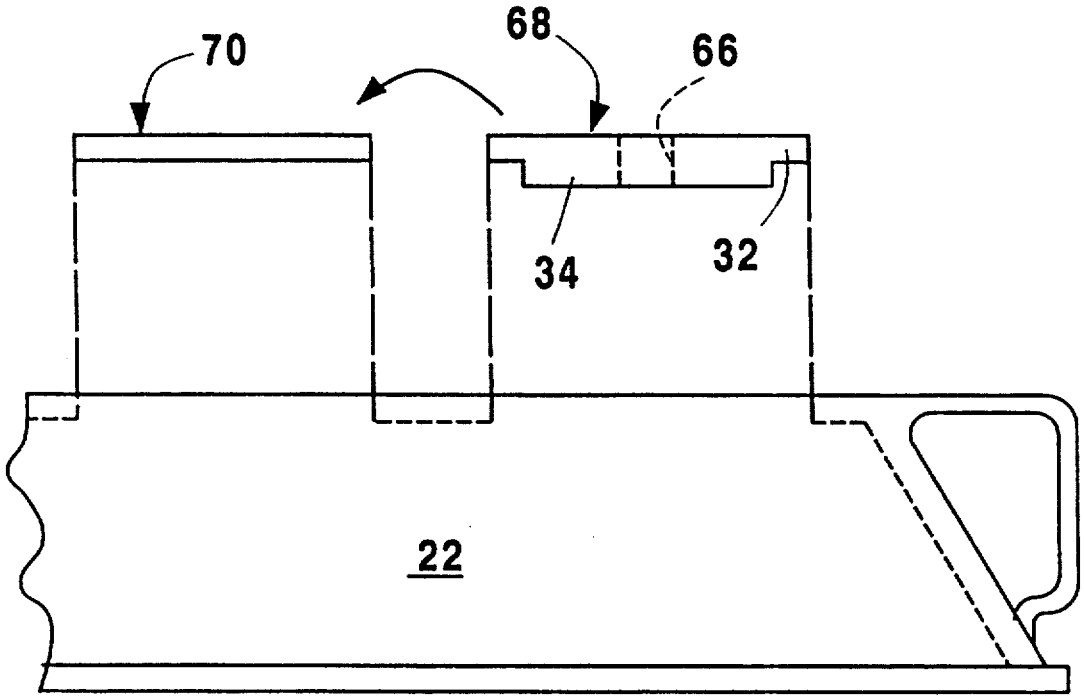
FIG. 10 is a side elevational view of the tank depicted in FIG. 3 showing one stage of relocation of a tank access hole.
Figure 11:
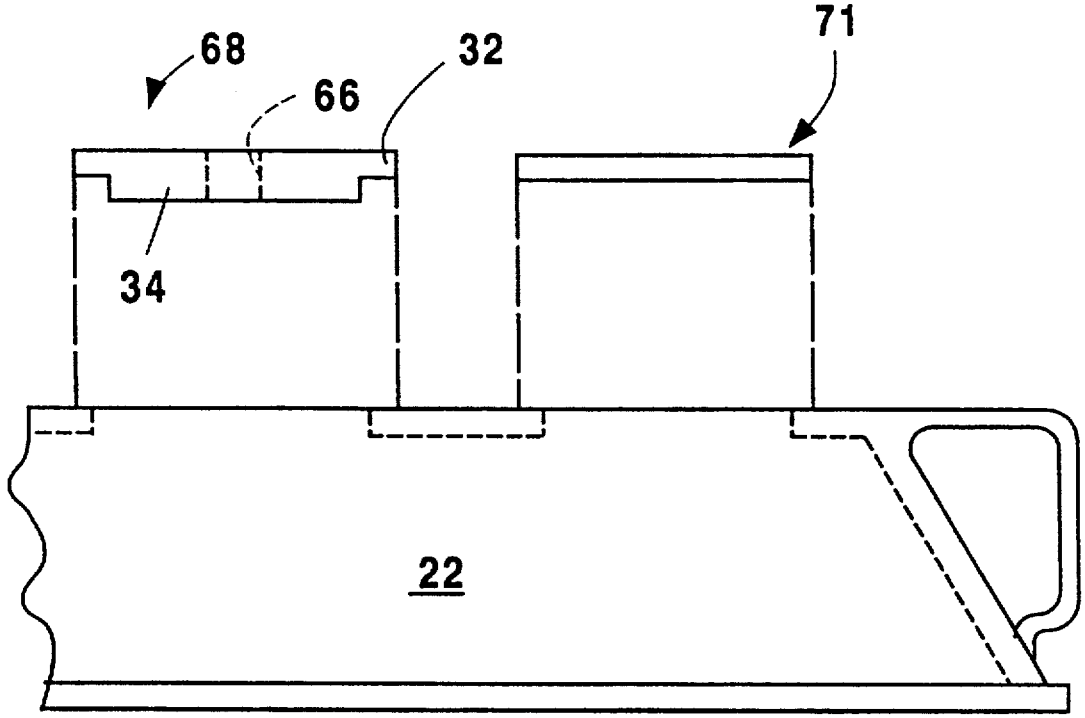
FIG. 11 is a front elevational view of the tank depicted in FIG. 3 showing a subsequent stage of the relocation of a tank access hole.

As shown in FIGS. 10 and 11, the unique construction of the heat exchanger assembly of the present invention provides for easy relocation of access openings or indentation points to other portions of the tank 22, for example, for low volume applications. As shown in FIG. 10, the region 68 around an as-cast or machined access hole 66, including thicker region 34, may be removed from tank 22 by conventional cutting processes through wall 32 for relocation. A suitable opening at the location of the tank in which the opening 66 is to be relocated is provided by cutting out a portion 70 of the tank wall, preferably of smaller diameter or width than the section 68. As shown in FIG. 11, as-cast access hole section 68 is then placed over the opening created by removal of section 70, and may then be bonded in place by the conventional techniques, such as welding. A suitable cover plate 71 of larger width or diameter is then welded or otherwise bonded over the opening of the original location of section 68 to seal tank 22. In this manner, a common casting mold may be provided for manufacturing tank 22, which may be then modified as desired by the aforementioned methods of relocating access holes required for specific low volume applications.

Additionally, special fitting or brackets may be added or relocated on the tank easily by welding when the preferred aluminum casting process is utilized for the tank. The same assembly methods may be utilized for crimping the aluminum tank to the header as used in plastic tanks, thereby reaping the same benefits as plastic tank constructions by eliminating numerous fasteners around the periphery of the tank and flange.

Thus, the present invention achieves the objects recited above in a configuration which is easy and of relatively low cost to manufacture, especially for low volume applications.

The preferred configurations of the elastomeric gasket and matting portions of the tank flange and header plate channel are shown in FIGS. 8 and 9. As seen in FIG. 9, the elastomeric gasket 50 is preferably preformed such that, as viewed in cross section, it contains straight leg sections 52 and 54 which meet at an angle B. As shown in FIG. 8, header plate channel 20 includes a downwardly extending inner side wall portion **20*a*, a bottom wall section 20*b* and a upwardly extending outer side wall 20*c*. Received within channel 20 is the elastromeric gasket 50 which is inserted by placing one leg 52 against inner side wall 20*a* and the other leg 54 against channel bottom wall 20*b*. After the tank flange 44 is inserted into channel 20, the upper portion 20*d* of the channel outer side wall is folded down over flange upper surface 44*d* to secure the tank in place. The lower surface 44*c* of the flange is spaced from the channel bottom wall 20*b* by leg 54 of the gasket, which completely fills at least a portion, and preferably substantially all, of the space between the flange lower surface and the channel bottom wall, as shown in FIG. 8. Flange inner side surface 44*a* is spaced from channel inner wall 20*a* by leg 52 of the gasket, which completely fills the space between the flange and channel and avoids formation of an undesirable crevice between the two. In this manner, the gasket reduces the potential for crevice corrosion in such region and furthermore, where dissimilar materials are utilized, reduces the common contact in this region of, for example, an aluminum tank and a brass header plate with the coolant 30** utilized in the heat exchanger.

Because of the configuration of the gasket, any potential problems of electrolytic or galvanic corrosion in the normally narrow crevice between the tank flange and header channel is addressed through the separation of the two materials by a nonconductive elastromeric gasket in any areas where the two dissimilar metals are in common contact with the coolant liquid. Even if a plastic tank is utilized, the configuration of the elastomeric gasket overcomes a corrosion problem which occurs in the metal header plate in the vicinity of the seal because of trapping of stagnant coolant between the tank and header and depletion of corrosion inhibitors in the coolant. The preferred elastomeric gasket of the present invention completely fills any gaps or spaces between the tank and the header, thereby eliminating the crevice which traps stagnant coolant.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A heat exchanger comprising:

a cast metal tank having predominately thin walls and a plurality of cast indentation points for starting a drilled hole and wherein a hole is drilled in the wall at at least one of said points to form an opening, said indentation points being located in defined, limited regions of the tank walls, said defined tank wall regions having a thickness greater than surrounding wall regions; and a header plate connected to a plurality of heat exchanging tubes, said header plate being mated with said tank.

2. The heat exchanger of claim 1 wherein said cast metal tank has an open side and a flange around said open side, said metal tank further including an as-cast extension on an end of said tank having a hole or indentation therein for mounting said tank to a frame.

3. The heat exchanger of claim 2 wherein said tank extension comprises an integral metal plate.

4. The heat exchanger of claim 2 wherein said tank flange has a side surface facing inward and a lower surface facing away from said tank and said header plate has a channel around its periphery for mating with the tank flange, said channel having a bottom wall facing and spaced from the flange lower surface and a side wall facing and spaced from the flange side surface, and further including an elastomeric gasket between said flange and said channel for forming a liquid-tight seal therebetween, said gasket completely filling the space between said flange side surface and said channel side wall, and at least a portion of the space between said flange lower surface and said channel bottom wall, for restricting contact of coolant with tank and header plate surfaces therebetween and reducing crevice corrosion therein.

5. The heat exchanger of claim 1 wherein said defined tank wall region has a thickness of at least about 1.5 times said surrounding wall regions.

6. The heat exchanger of claim 1 wherein said defined tank wall region has a thickness of at least about 2 times said surrounding wall regions.

7. A method for making a heat exchanger comprising the steps of:

a) casting a metal tank having predominately thin walls and at least one indentation point for starting a drilled hole, said indentation point being cast in a defined region of the tank wall and having a thickness greater than surrounding wall regions;

b) drilling a hole at said indentation point and, optionally, tapping threads in said hole, for forming an access opening in said tank, said access opening being surrounded and reinforced by said defined region of the tank wall having a thickness greater than surrounding wall regions; and c) attaching said tank to a heat exchanger header plate.

8. The method of claim 7 wherein said defined tank wall region has a thickness of at least about 1.5 times said surrounding wall regions.

9. The method of claim 7 wherein said defined tank wall region has a thickness of at least about 2 times said surrounding wall regions.

10. The method of claim 7 including the step of tapping threads in said hole to form a threaded access opening for said tank.

11. The method of claim 7 including the step of tapping threads in said hole to form a threaded access opening for said tank.

12. A method of making a heat exchanger comprising the steps of:

a) obtaining a tank having an open side and a flange around said open side, said tank having predominately thin walls and at least one indentation point for starting a drilled hole, said indentation point being formed in a defined region of the tank wall having a thickness of at least about 1.5 times surrounding wall regions;

b) drilling a hole at said indentation point for forming an access opening in said tank, said access opening being surrounded and reinforced by said defined region of the tank wall having a thickness greater than surrounding wall regions; and c) attaching said tank to a heat exchanger header plate by crimping an outside edge of said header plate around said tank flange.

13. The method of claim 12 wherein said defined tank wall region has a thickness of at least about 2 times said surrounding wall regions.

14. A heat exchanger comprising:

a cast metal tank having predominately thin walls and a plurality of defined, limited regions having a thickness greater than surrounding wall regions and wherein a hole is drilled in the wall at at least one of said limited regions to form an opening; and a header plate connected to a plurality of heat exchanger tubes, said header plate being mated with said tank.

15. The heat exchanger of claim 14 wherein said defined tank wall regions have a thickness of at least about 1.5 times said surrounding wall regions.

16. The heat exchanger of claim 14 wherein said defined tank wall regions have a thickness of at least about 2 times said surrounding wall regions.

17. A method of making a heat exchanger comprising the steps of:

a) obtaining a tank having an open side and a flange around said open side, said tank having predominately thin walls and at least one defined region of the tank wall having a thickness greater than surrounding wall regions;

b) drilling a hole at at least one of said defined regions for forming an access opening in said tank, said access opening being surrounded and reinforced by said defined region of the tank wall having a thickness greater than surrounding wall regions; and c) attaching said tank to a heat exchanger header plate.

18. The method of claim 17 wherein said defined tank wall regions have a thickness of at least about 1.5 times said surrounding wall regions.

19. The method of claim 17 wherein said defined tank wall regions have a thickness of at least about 2 times said surrounding wall regions.

20. An article of manufacture adapted for use in making a heat exchanger wherein the article is mated with a header plate connected to a plurality of heat exchanger tubes comprising:

a cast metal tank having predominately thin walls with at least one defined limited region of the tank wall having a thickness greater than surrounding wall regions and a cast indentation point for starting a drilled hole at said defined limited region.

21. The article of manufacture of claim 20 wherein said defined tank wall region has a thickness of at least about 1.5 times said surrounding wall regions.

22. The article of manufacture of claim 20 wherein said defined tank wall region has a thickness of at least about 2 times said surrounding wall regions.

* * * * *

UNITED STATES PATENT AND TRADEMARK OFFICE

CERTIFICATE OF CORRECTION

PATENT NO. : 5,373,896

DATED : December 20, 1994

INVENTOR(S) : Osborn

It is certified that error appears in the above-identified patent and that said Letters Patent is hereby corrected as shown below:

On title page, item [54] in the title, before "HEAT" insert

—ADAPTABLE— and col. 1, line 1, should be the same.

Column 1, line 45: After the word "fittings", delete "-" and insert - -.- -.

Column 1, line 63: Delete the space between the word "permits".

Column 2, line 12: Delete the space between the word "skilled".

Signed and Sealed this

Fourteenth Day of March, 1995

*Attest:*

*Attesting Officer*

BRUCE LEHMAN

*Commissioner of Patents and Trademarks*